United States Patent [19]

Gould et al.

[11] Patent Number: 4,914,435

[45] Date of Patent: Apr. 3, 1990

[54] PEDESTRIAN TRAFFIC SIGNAL

[75] Inventors: Samuel Gould, San Pedro; James S. Gould, Los Alamitos, both of Calif.

[73] Assignee: Indicator Controls Corporation, Gardena, Calif.

[21] Appl. No.: 861,828

[22] Filed: May 12, 1986

Related U.S. Application Data

[63] Continuation of Ser. No. 653,355, Sep. 24, 1984, abandoned.

[51] Int. Cl.[4] ..... G08G 1/095

[52] U.S. Cl. ..... 340/144; 340/925; 362/812

[58] Field of Search ..... 340/944, 925, 103, 105; 362/327, 328, 812

[56] References Cited

U.S. PATENT DOCUMENTS

| | | | |
|---|---|---|---|
| 3,141,149 | 7/1964 | Lawton | 340/944 |
| 3,768,070 | 10/1973 | Lawton | 340/944 |
| 4,316,241 | 2/1982 | Gulliksen | 362/268 |
| 4,435,696 | 3/1984 | Gould et al. | 340/944 X |
| 4,644,452 | 2/1987 | Kasboske | 362/214 |

*Primary Examiner*—Joseph A. Orsino
*Assistant Examiner*—Jeffery A. Hofsass
*Attorney, Agent, or Firm*—Keith D. Beecher

[57] ABSTRACT

A neon-type pedestrian traffic signal which includes a housing. A partition divides the housing into two separate compartments, each compartment having a parabolic-shaped rear wall covered with a suitable reflective substance. A tubular-type neon lamp is mounted in each compartment as the focal point of the corresponding parabolic-shaped rear wall. Each neon lamp extends outwardly from the rear wall. The housing has an open front, and a face plate fits over the open front. The face plate has the appropriate "WALK" and "DONT WALK" symbols positioned over the respective compartments. An egg crate visor is mounted over the face plate to shield the pedestrian traffic signal from sunlight. Due to the configuration of the rear reflective wall of each compartment, the tendency for symbols on the face plate to be visible when not illuminated is minimized.

5 Claims, 1 Drawing Sheet

PEDESTRIAN TRAFFIC SIGNAL

This application is a continuation of copending application Ser. No. 653,355, filed Sept. 24, 1984 now abandoned.

BACKGROUND OF THE INVENTION

Pedestrian traffic signals are presently in widespread use. Most pedestrian traffic signals are of the type which include a rectangular case, and a face plate mounted on the front of the case having a first section bearing the legend "DONT" and a second section bearing the legend "WALK". It is the present practice to replace the words with universally understood symbols. In the neon-type of pedestrian traffic signal, neon tubes are mounted within the case, and the neon tubes are selectively energized. When one of the neon tubes is energized, the command "DONT WALK", or the corresponding symbol, on the face plate is illuminated; when the other of the neon tubes is energized, the word "WALK", or corresponding symbol, is illuminated.

Problems have been encountered in the past in attempts to alleviate the effects of sunlight on the pedestrian signals. When sunlight is reflected from the face plate and interior reflective surface of the signal, it makes it difficult for the pedestrian to understand whether the "WALK" or the "DONT WALK" condition exists.

Visors of different types have been proposed in the past to shade the face of the signal from the effects of sunlight. For example, an egg crate type of visor is described and claimed in U.S. Pat. No. 3,863,251 which issued Jan. 28, 1975 to the present inventors.

However, the prior art visors have not been completely effective in the case of the neon-type signals due to the reflections of sunlight from the reflective surface of the planar rear wall of the prior art signal.

In accordance with the present invention, a pedestrian crossing neon signal is provided in which the housing for the neon lamps is shaped to provide two compartments separated by a divider, with each of the compartments having a parabolic-shaped rear wall and an open front. A neon lamp is positioned in each compartment, and instead of extending across the compartment, the each lamp is positioned at the focal point of the parabolic rear wall of the corresponding compartment, and each neon lamp extends outwardly a short distance from the rear wall of the corresponding compartment.

The result is that when the particular neon lamp is energized, all of its light is directed outwardly through the face plate across the plane of the section of the face plate in front of its compartment so as to illuminate the word or symbol on that section of the face plate to a maximum intensity.

However, when the particular neon lamp is off, any sunlight entering the compartment is reflected by the rear wall to the focal point, and a minimum amount of sunlight is reflected back through the face plate.

Accordingly, the visor now protects the face plate of the signal from external surface reflections, and the reflective rear wall protects the face plate of the signal from internal reflections. The result is that the word or symbol of the illuminated neon lamp is readily visible, even in the presence of sunlight, because of the reflective properties of the parabolic reflective rear wall. However, the word or symbol of the other neon lamp is completely obliterated to all intents and purposes.

The housing of the pedestrian signal of the invention may be constructed of appropriate plastic, such as polycarbonate, or other suitable material, and a highly reflective coating is formed on the inner surface of the housing. This coating, for example, may be aluminum, and it may be formed on the plastic housing by known vacuum deposition processes. Each of the two compartments in the housing, therefore, has a highly reflective surface behind its neon lamp, and the surface in each of the compartments has a parabolic shape. As mentioned above, the neon lamp is mounted at the focal point of the parabolic surface, so that essentially all the light generated by the lamp is directed through the section of face plate in front of the particular compartment.

The section of the face plate covering one of the compartments in the housing is masked with black opaque paint to form the words "DONT WALK", or the corresponding symbol. The section of the face plate covering the other compartment, on the other hand, is masked with black opaque paint to form the words "WALK", or the corresponding symbol.

DETAILED DESCRIPTION OF THE ILLUSTRATED EMBODIMENT

Figure 1:
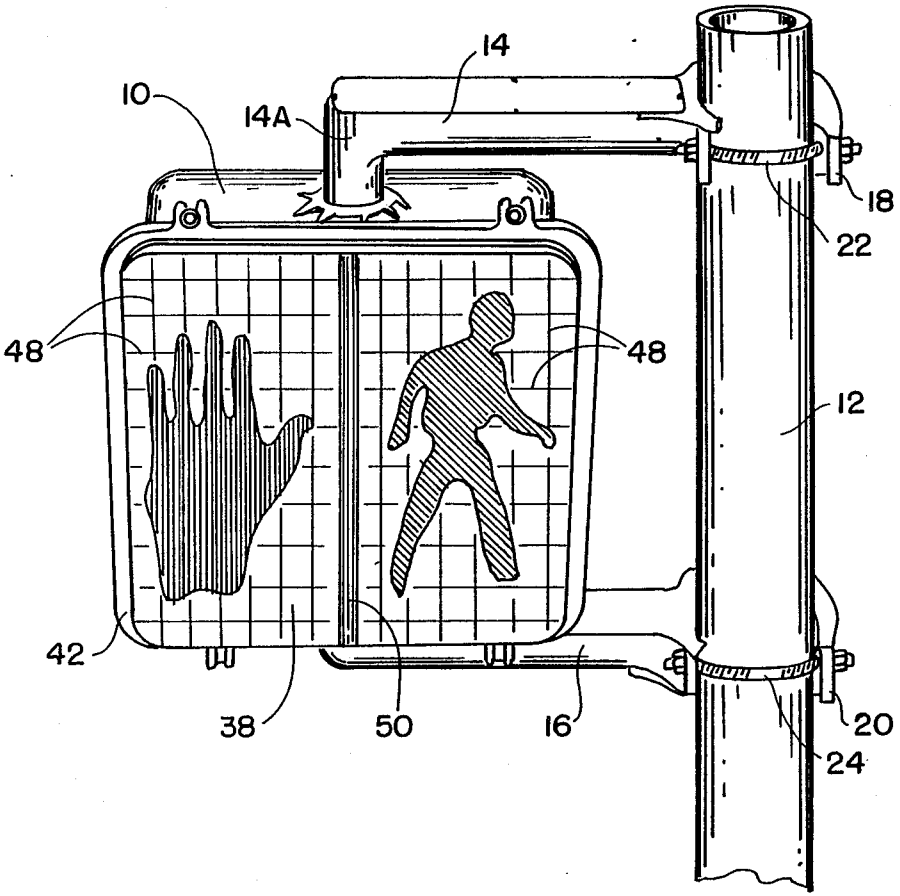
FIG. 1 is a representation of a pedestrian traffic signal which may be constructed to incorporate the concepts of the present invention.

As shown in FIG. 1, a rectangular-shaped pedestrian signal case 10 is mounted on a hollow upright supporting pole 12 by a pair of elonagated brackets 14 and 16. The elongated brackets each has an integral protuberance, such as protuberance 14A, at the distal ends thereof, and these protuberances extend into mounting holes in the upper and lower sides of the case 10, the protuberances being attached to the case by appropriate fastening means.

Brackets 14 and 16 are supported on pole 12 by shoes, such as the shoes 18 and 20, and by bolts, such as bolts 22 and 24, which extend between the ends of the brackets 14, 16 and the shoes 18, 20. In the illustrated embodiment, the bolts 22 and 24 have an arcuate configuration to extend partially around the peripheral surface of the pole.

Figure 2:
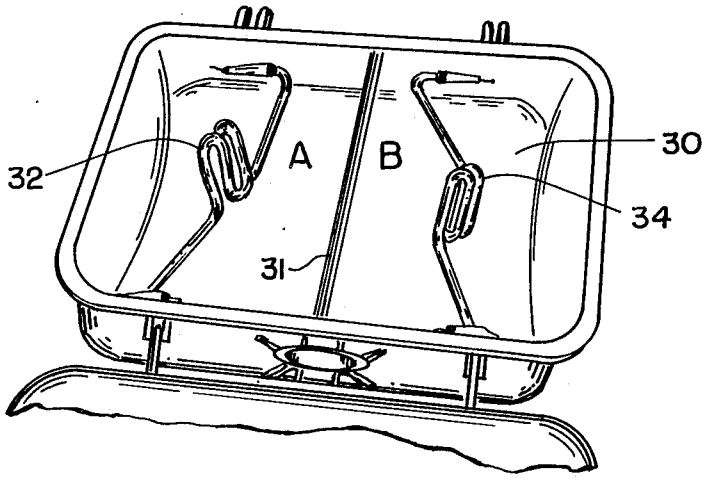
FIG. 2 is a view of the pedestrian signal of FIG. 1 in an open condition to reveal the internal components of the unit.

The pedestrian signal unit of the invention includes a housing 30 (FIG. 2) which is adapted to fit into the rectangular case 10 of FIG. 1. The housing 30, as shown in FIG. 2 has a partition 31 which separates it into two compartments A and B, each with an open front. The housing is shaped so that the rear wall of each of the compartments A and B has a parabolic configuration. Neon lamps 32, 34 of the illustrated configuration being mounted in the two compartments at the focal points of the respective parabolic surfaces, each extending outwardly from the rear wall.

As stated above, the housing 30 may be formed of an appropriate plastic, and a reflective coating may be formed on the plastic, by suitable processes such as vacuum deposition, so that the rear wall of each compartment A and B is highly reflective. The neon lamps 32 are energized by an appropriate power source mounted in the signal 10.

A face plate 38 is mounted in front of the housing 30 to close the open front of the housing. The "DONT WALK" symbol is formed on one section of the face plate 38, and the "WALK" symbol is formed on a second section. A partition 50 is mounted so as to extend partition 31 sufficiently to come in contact with face plate 38 in the area between the "DONT WALK" symbol and the "WALK" symbol. The partition 50 is preferably formed of resilient material which allows movement of face plate 38 and yet maintains an effective light barrier between the two compartments so as to assure that when the lamp 34 is energized, only the "WALK" symbol of face plate 38 will be illuminated, and when the lamp 32 is energized, only the "DONT WALK" symbol of the face plate will be illuminated.

An egg crate visor 48 of the type described in U.S. Pat. No. 3,863,251 which issued Jan. 28, 1975 to the present inventors, is mounted on frame 42 in front of the face plate 38.

It will be appreciated that although a particular embodiment of the invention has been shown and described, modifications may be made. It is intended in the claims to cover the modifications which fall within the true spirit and scope of the invention.

We claim:

1. A pedestrian traffic signal unit to be mounted in a rectangular case, which includes a rectangular housing adapted to be fitted into said case, said housing having an open front and having a partition therein separating the housing into first and second compartments, each of said first and second compartments having a reflective rear wall with a parabolic configuration in both horizontal and vertical planes; a first tubular lamp mounted on said housing and extending across said first compartment and configured to extend outwardly at the focal point of the reflective rear wall of said first compartment so that when energized all of its light is directed outwardly through the portion of the open front of the housing facing said first compartment, and when de-energized any light entering through said portion of the open front of the housing is reflected to the focal point; a second tubular lamp mounted on said housing and extending across said second compartment and configured to extend outwardly at the focal point of the reflective rear wall of said second compartment so that when energized all of its light is directed outwardly through the portion of the open front of the housing facing said second compartment, and when de-energized any light entering through said last-mentioned portion of the open front is reflected to the last-named focal point; and a face plate covering the open front of the housing and bearing first indicia to be illuminated by the tubular lamp in the first compartment, and bearing second indicia to be illuminated by the tubular lamp in the second compartment.

2. The pedestrian traffic signal defined in claim 1, in which the housing is formed of a plastic material having a reflective coating thereon to form the reflective rear wall of each of the compartments.

3. The pedestrian traffic signal defined in claim 1, in which the first indicia on said face plate comprises a "DONT WALK" symbol, and a second indicia on said face plate comprises a "WALK" symbol.

4. The pedestrian traffic signal defined in claim 1, and which includes a visor mounted over the face plate to shield the face plate from sunlight.

5. The pedestrian traffic signal defined in claim 1, in which the first and second tubular lamps are neon lamps.

* * * * *